United States Patent [19]

Tenhaaf

[11] 4,390,420

[45] Jun. 28, 1983

[54] WIRE CLOTH TENSIONING APPARATUS

[75] Inventor: Peter H. Tenhaaf, St. Catherines, Canada

[73] Assignee: Combustion Engineering, Inc., Windsor, Conn.

[21] Appl. No.: 320,258

[22] Filed: Nov. 12, 1981

[51] Int. Cl.[3] ..... B07B 1/48

[52] U.S. Cl. ..... 209/403; 209/405; 209/319

[58] Field of Search ..... 209/401–403, 209/405, 399, 319, 315, 317

[56] References Cited

U.S. PATENT DOCUMENTS

| | | | |
|---|---|---|---|
| 1,438,489 | 12/1922 | Hawley | 209/403 |
| 1,459,844 | 6/1923 | Mitchell | 209/326 |
| 1,923,229 | 8/1933 | Robins | 209/326 |
| 2,511,239 | 6/1950 | Behnke et al. | 209/319 X |
| 2,864,500 | 12/1958 | Miller | 209/403 |
| 2,959,285 | 11/1960 | Tonjes et al. | 209/319 |
| 3,388,797 | 6/1968 | Herman et al. | 209/241 |
| 3,406,823 | 10/1968 | Crain | 209/403 X |

*Primary Examiner*—Ralph J. Hill

*Attorney, Agent, or Firm*—Robert L. Olson

[57] ABSTRACT

Apparatus for supporting screen (12) in a screening machine (10) that will permit long-life of the screen even when subjected to heat and vibration. The screen or wire cloth edge is folded over (30) and fastened or joined (42, 44, 46), with a metal rod (32) inserted down through the foldover space (34). Spring clips (40) or other adjustable tensioning devices attach the steel rod (32) to the screening machine frame (50), thus placing the screen (12) in tension.

6 Claims, 4 Drawing Figures

WIRE CLOTH TENSIONING APPARATUS

BACKGROUND OF THE INVENTION

In large screening machines, better methods of attaching the screen to the frame are always being looked for. In most screening machines, the screen is vibrated to assist the separating or screening process. In addition, many materials, such as potash, enter the screening machine at an elevated temperature (200° F. or more). This constant exposure to vibration and high temperatures makes for relatively short lifespans of the wire cloth. The manner in which the screen is secured within the frame has a marked effect on the durability of such screen.

One previous means of securing screen within the frame of a screening machine was by putting a cloth tape along the edges, and securing metal grommets in the tape. A resilient attaching means was secured in the grommets and the frame. High temperature operation tends to make the tape become brittle and charred. In addition, the grommets tend to pull out of the tape and screen, causing uneven tension in the screen. This leads to early failure of the screen.

SUMMARY OF THE INVENTION

In accordance with the invention, screen or wire cloth is secured to the frame of a screening machine by folding over the edges of the screen and fastening or joining the foldovers. A metal rod is inserted down into the foldover space, and is attached to the frame by resilient spring clips, or other tensioning devices, thus placing the screen in tension.

DESCRIPTION OF THE PREFERRED EMBODIMENT

Figure 1:
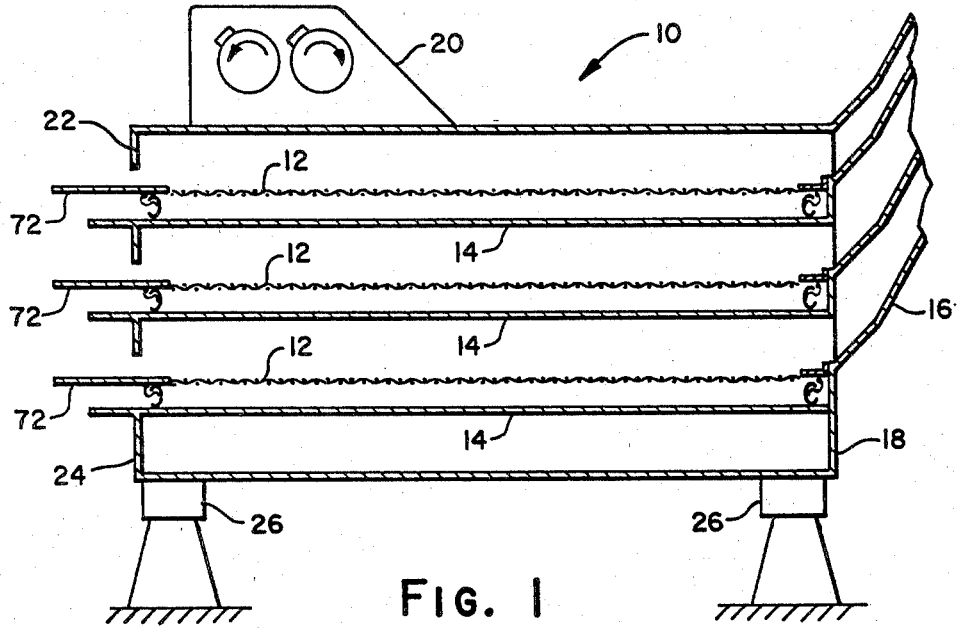
FIG. 1 is a cross sectional side view of a screening machine incorporating the invention.

Looking now to FIG. 1, a screen separating machine 10 includes a plurality of screens 12 with an imperforate pan 14 located beneath each. The material to be separated is fed by means of chute 16 to the inlet end 18 of the machine. Vibrating means 20 helps the material to move from the inlet end to the outlet end 22 of the separator. The vibrator also causes the fines to be separated out, falling onto the pans 14. The frame 24 of the separator 10 is resiliently supported at each corner thereof on rubber blocks or mounts 26.

Figure 2:
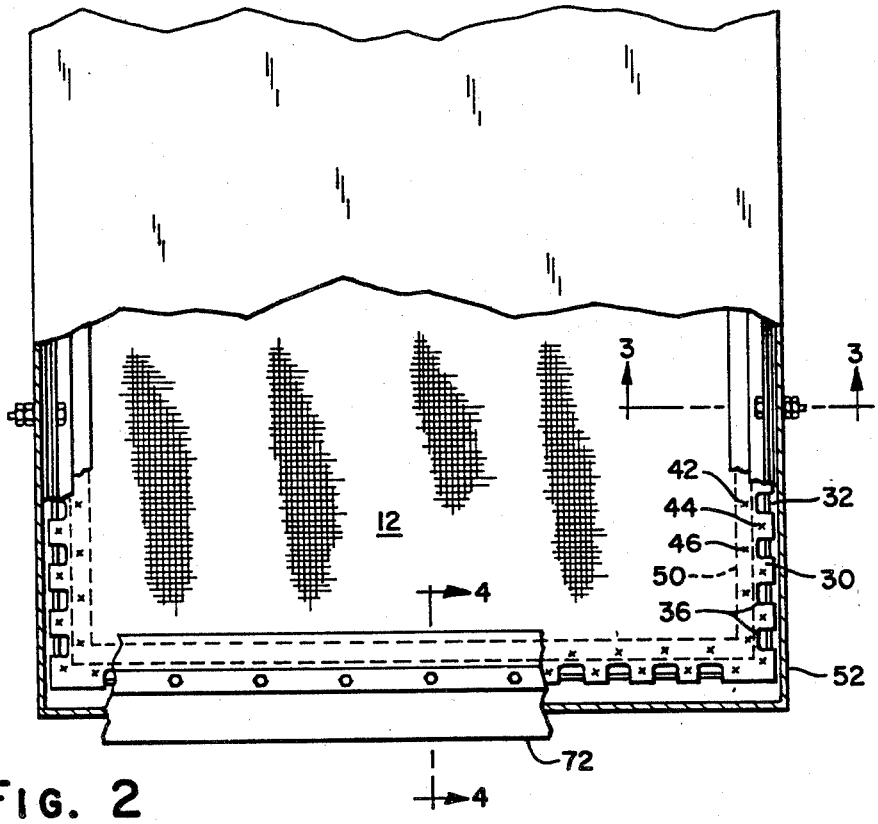
FIG. 2 is a partial plan view of one of the screens, with the edge seal not showing.
Figure 3:
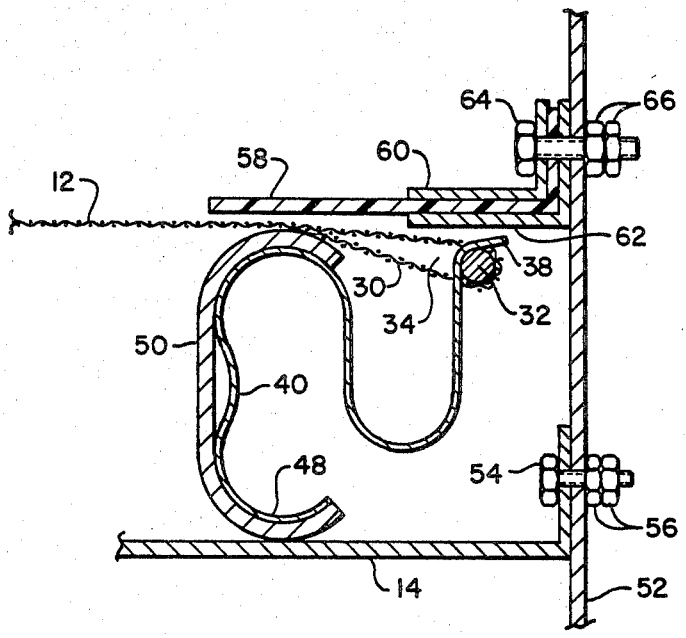
FIG. 3 is an enlarged view of the screen support taken on lines 3—3 of FIG. 2.

Looking now to FIGS. 2 and 3, the manner in which the screen or wire cloth 12 is supported in the separating machine is shown in greater detail. Looking first to FIG. 2, this is a partial plan view of one of the screens, with the edge seal not shown. The screen 12 has a folded over portion 30 which extends along two opposite sides, or around all four sides, thereof. Metal rods 32 are inserted through the passageway 34 (FIG. 3) formed by the folded over screen portion.

A plurality of openings 36 are punched or otherwise cut in the edge of the folded over portion around the entire periphery prior to the rods being inserted. These openings permit the hooked end 38 (FIG. 3) of spring clips 40 to be attached to the rods 32. The folded over portion of the screen is secured by some means such as spot welding, shown at 42, 44 and 46. This prevents the folded over portion from tearing loose during operation. The other ends 48 of the clips 40 are snapped into the C-shaped recess of frame 50, which also extends around the entire periphery of the separating machine. This arrangement places the screen in tension through the resilient spring clips 40 either along two opposite edges, or around its entire periphery. The C-frame 50 is supported on pan 14, and is preferably attached thereto, and the pan 14 is secured to the outer wall 52 by means of nuts and bolts 54, 56.

Material being separated is prevented from bypassing the screen around its edges by a rubber or plastic seal member 58, which is held in place by metal plates 60, 62, which are secured to the outer wall 52 by means of nuts and bolts 64, 66.

Figure 4:
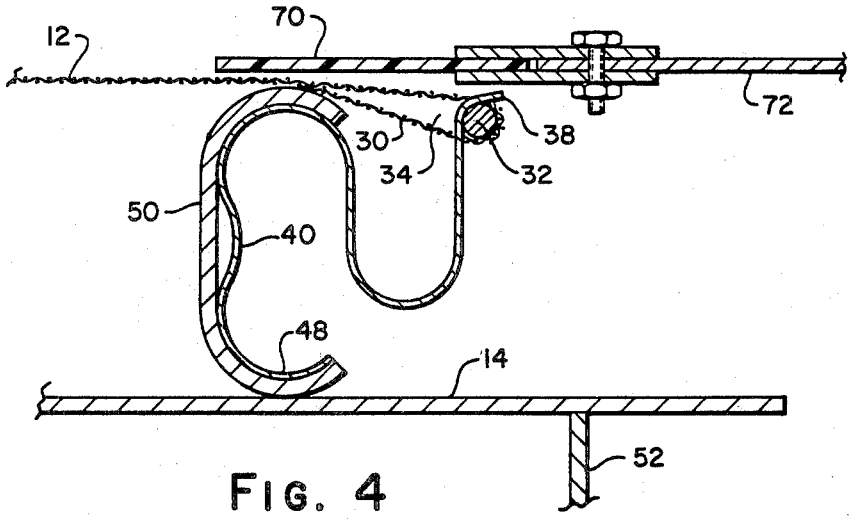
FIG. 4 is an enlarged view of the screen support at the outlet end of the separator machine.

As shown in FIG. 4, the support arrangement at the discharge end is substantially the same as it is on the other three sides. The only difference is that the flexible seal member 70 is fastened to the outlet chute 72, rather than to a vertical side wall. Thus there will be no wall or lip over which the large particles must pass in order to be discharged from the machine.

From the above, it can be seen that each screen is held in tension along two opposite sides or around its entire periphery. The metal rods evenly distribute the tensile forces along the entire edge of the screen, rather than having concentrated forces at given points, which is what happens when grommets are placed in the screen for attachment to the frame. The screens are less costly to manufacture than previous methods, and the screens last longer. They will not rapidly deteriorate even when exposed to high temperature and vibration.

I claim:

1. In a screening apparatus, a frame, support means for attaching the screen within said frame, said support means including a folded over edge portion of the screen on at least two opposite sides along their entire edges, means for securing the folded over edge portion to the inner portion of the screen, thus forming passage means enclosed by the screen which extends along the two opposite sides, rod means extending through the passage means on the two opposite sides of the screen, a plurality of spaced openings formed in the screen on each said opposite side thereof, through which the rod means are exposed, and resilient means for securing the rod means to the frame at each of the spaced openings.

2. The screening apparatus set forth in claim 1, including means for vibrating the screen.

3. The screening apparatus set forth in claim 1, wherein the support means secures all four sides of the screen to said frame.

4. The screening apparatus set forth in claim 1, wherein the resilient means are resilient spring clips.

5. The screening apparatus set forth in claim 1, wherein the folded over edge portion is spot welded.

6. The screening apparatus set forth in claim 1, wherein the folded over edge portion is spot welded on all three sides surrounding each opening.

* * * * *